US010798991B2

(12) United States Patent
Thorne

(10) Patent No.: US 10,798,991 B2
(45) Date of Patent: Oct. 13, 2020

(54) SHOE INSERT DEVICE

(71) Applicant: Maggie Thorne, Clearwater, FL (US)

(72) Inventor: Maggie Thorne, Clearwater, FL (US)

( * ) Notice: Subject to any disclaimer, the term of this patent is extended or adjusted under 35 U.S.C. 154(b) by 32 days.

(21) Appl. No.: 16/173,461

(22) Filed: Oct. 29, 2018

(65) Prior Publication Data

US 2019/0059509 A1 Feb. 28, 2019

Related U.S. Application Data

(63) Continuation-in-part of application No. 15/337,901, filed on Oct. 28, 2016, now Pat. No. 10,111,489.

(51) Int. Cl.

| | |
|---|---|
| ***A43B 7/14*** | (2006.01) |
| ***A43B 17/00*** | (2006.01) |
| ***A43B 17/18*** | (2006.01) |
| *A43B 17/02* | (2006.01) |

(52) U.S. Cl.

CPC ..... *A43B 7/144* (2013.01); *A43B 7/149* (2013.01); *A43B 17/006* (2013.01); *A43B 17/18* (2013.01); *A43B 17/02* (2013.01)

(58) Field of Classification Search

CPC ..... A43B 7/144; A43B 7/149; A43B 17/006; A43B 17/18; A43B 17/02

See application file for complete search history.

(56) References Cited

U.S. PATENT DOCUMENTS

| | | | | | |
|---|---|---|---|---|---|
| 1,475,058 | A | | 11/1923 | Davis | |
| 1,575,490 | A | * | 3/1926 | Krech | A43B 7/142 36/160 |
| 1,594,034 | A | | 7/1926 | Anderson | |
| 1,945,780 | A | * | 2/1934 | Johnson | A43B 21/32 36/37 |
| 2,404,731 | A | | 7/1946 | Johnson | |
| 2,662,309 | A | | 12/1953 | Morton | |
| 2,814,133 | A | * | 11/1957 | Herbst | A43B 13/00 36/80 |
| 2,909,854 | A | | 10/1959 | Edelstein | |
| 3,244,176 | A | * | 4/1966 | Neu | A61F 13/067 36/140 |
| 3,373,513 | A | * | 3/1968 | Jewell | A43B 13/34 36/80 |
| 4,235,028 | A | | 11/1980 | Riggs | |
| 4,336,661 | A | | 6/1982 | Medrano | |
| 4,360,027 | A | * | 11/1982 | Friedlander | A43B 7/14 36/140 |
| 4,794,707 | A | * | 1/1989 | Franklin | A43B 7/14 36/107 |
| 4,862,604 | A | | 9/1989 | Hauser | |
| D422,782 | S | | 4/2000 | Kress | |
| 6,460,275 | B1 | * | 10/2002 | Bennett | A61F 5/14 36/144 |
| 6,474,003 | B2 | | 11/2002 | Erickson | |
| 6,817,115 | B2 | * | 11/2004 | Polifroni | A43B 7/141 36/145 |
| 6,990,756 | B1 | | 1/2006 | Wang | |

(Continued)

*Primary Examiner* — Ted Kavanaugh

(57) ABSTRACT

A shoe insert device relieves pressure on a heel when a shoe is worn. The device includes a panel configured to be positioned in a shoe. A heel alignment pad is U-shaped. The heel alignment pad is positioned on and extends upwardly from an upper surface of the panel wherein the heel alignment pad is configured to extend around and support a heel of the foot positioned in the shoe.

11 Claims, 5 Drawing Sheets

(56) References Cited

U.S. PATENT DOCUMENTS

| | | | | |
|---|---|---|---|---|
| 7,614,164 | B2 | 11/2009 | Morales et al. | |
| 8,819,961 | B1 | 9/2014 | Ellis | |
| 2003/0110662 | A1 | 6/2003 | Gilman | |
| 2006/0086004 | A1 * | 4/2006 | Davis | A43B 7/144 36/43 |

* cited by examiner

SHOE INSERT DEVICE

CROSS-REFERENCE TO RELATED APPLICATIONS

This application is a continuation in part of application Ser. No. 15/337,901 filed Oct. 28, 2016, and issued as U.S. Pat. No. 10,111,489 on Oct. 30, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shoe insert devices and more particularly pertains to a new shoe insert device for relieving pressure on a heel when a shoe is worn.

BRIEF SUMMARY OF THE INVENTION

An embodiment of the disclosure meets the needs presented above by generally comprising a panel configured to be positioned in a shoe. A heel alignment pad is U-shaped. The heel alignment pad is positioned on and extends upwardly from an upper surface of the panel wherein the heel alignment pad is configured to extend around and support a heel of the foot positioned in the shoe.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
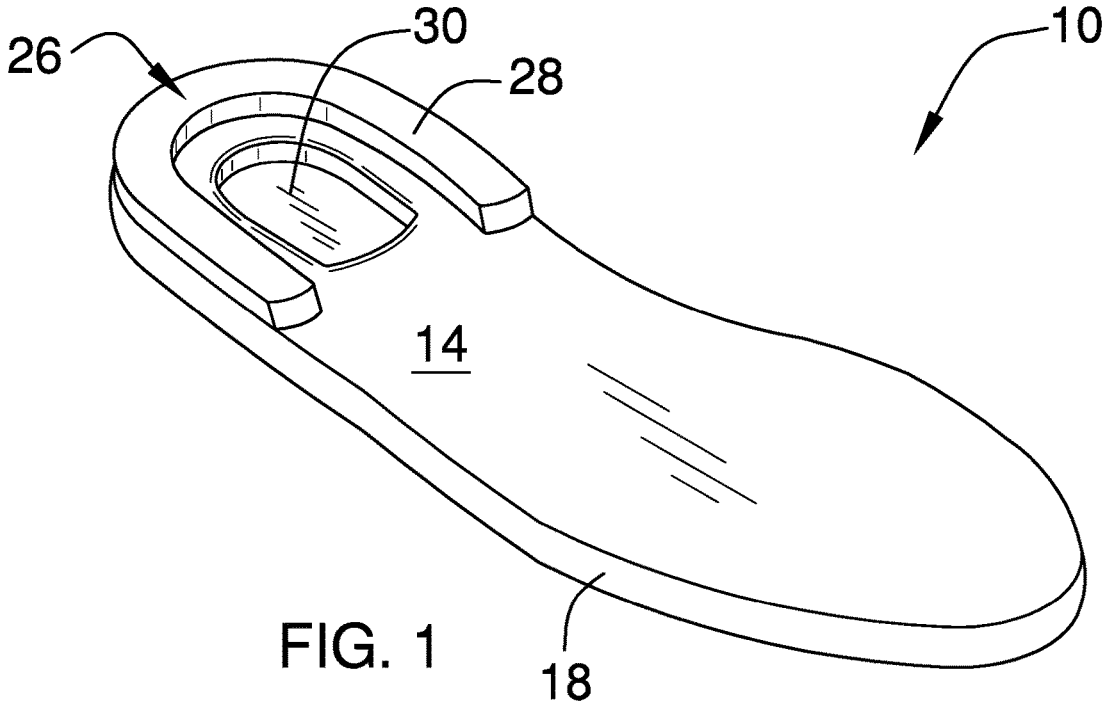
FIG. 1 is a top front side perspective view of a shoe insert device according to an embodiment of the disclosure.

With reference now to the drawings, and in particular to FIGS. 1 through 13 thereof, a new shoe insert device embodying the principles and concepts of an embodiment of the disclosure and generally designated by the reference numeral 10 will be described.

As best illustrated in FIGS. 1 through 6 and 12, the shoe insert device 10 generally comprises a panel 12 configured to be positioned in a shoe (not shown) of conventional design. The panel 12 has an upper surface 14, a lower surface 16, and a perimeter edge 18 extending around the panel 12. The panel 12 has a heel portion 20, a front portion 22, and a medial portion 24 positioned and extending between the heel portion 20 and the front portion 22 wherein the panel 12 is configured to extend fully under a foot positioned in the shoe. A heel alignment pad 26 is U-shaped. The heel alignment pad 26 is positioned on and extends upwardly from the upper surface 14 of the panel 12 wherein the heel alignment pad 26 is configured to extend around and support a heel of the foot positioned in the shoe. The heel alignment pad 26 has a top surface 28 which may be positioned parallel to the upper surface 14 of the panel 12 when uncompressed. The panel 12 and the heel alignment pad 26 may each be constructed of a resilient compressible material such as silicone, rubber, or the like. The material may be the same or different for the panel 12 and the heel alignment pad 26.

A heel well 30 extends into the upper surface 14 of the panel 12. The heel alignment pad 26 extends around the heel well 30. The heel alignment pad 26 may further extend fully around the heel well 30 such that a front edge 32 of the heel well 30 is inset relative to a straight line extending between opposite ends 34 of the heel alignment pad 26. In one embodiment shown particularly in FIGS. 4 through 6, a rear section 36 of a peripheral edge 38 of the heel alignment pad 26 is inset from the perimeter edge 18 of the panel 12.

Figure 2:
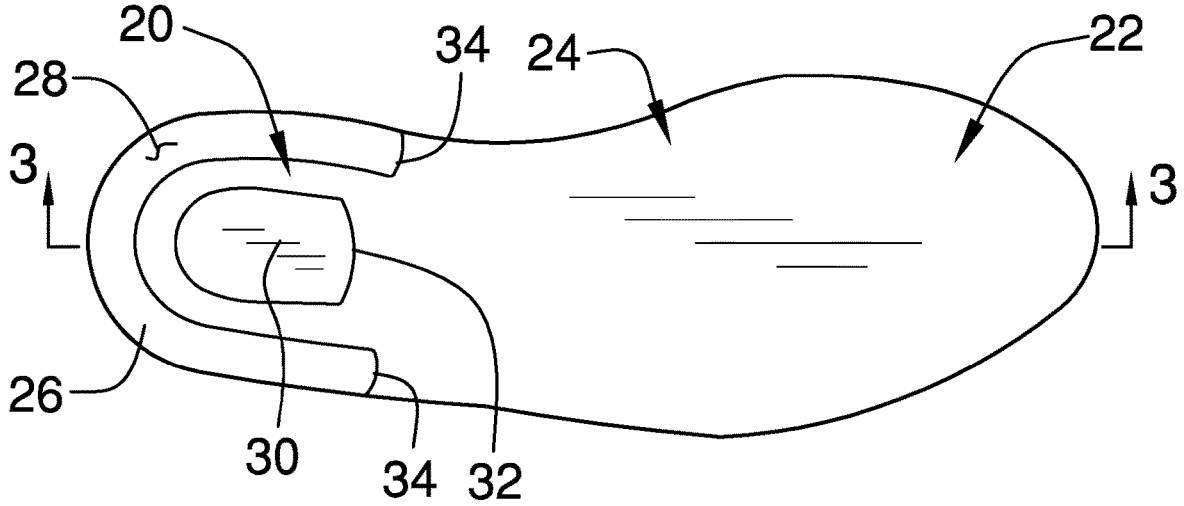
FIG. 2 is a top view of an embodiment of the disclosure.
Figure 3:
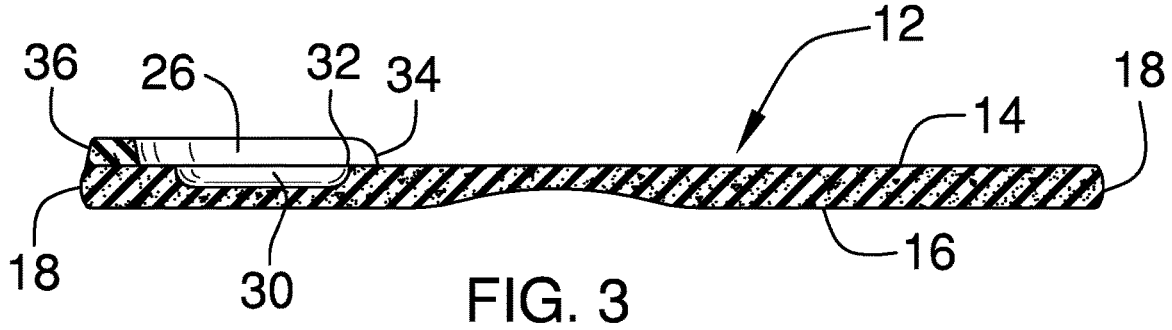
FIG. 3 is a cross-sectional view of an embodiment of the disclosure taken along line 3-3 of FIG. 2.
Figure 4:
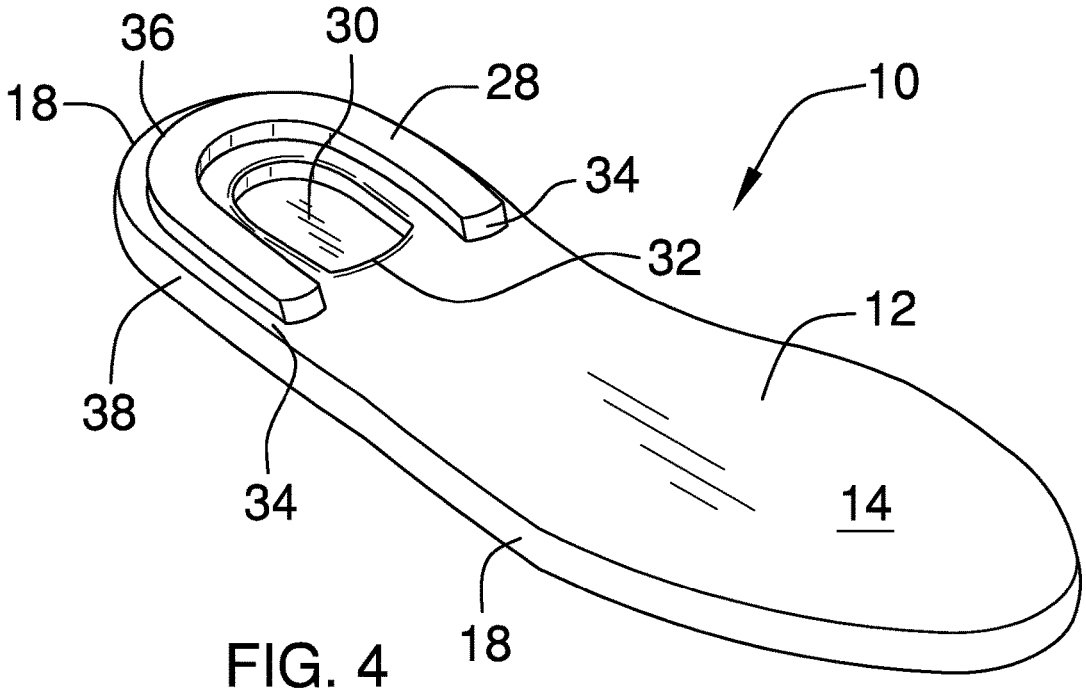
FIG. 4 is a top front side perspective view of an embodiment of the disclosure.
Figure 5:
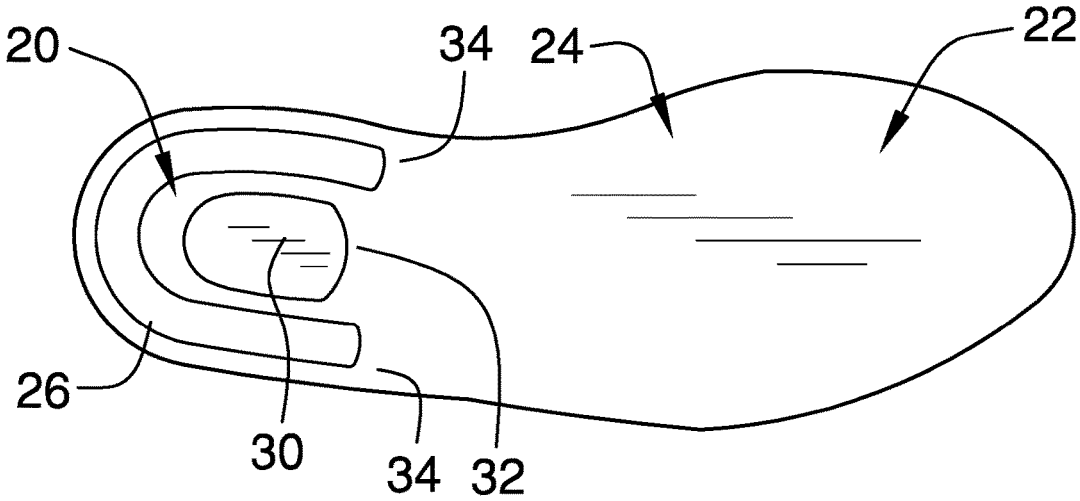
FIG. 5 is a top view of an embodiment of the disclosure as in FIG. 4.
Figure 6:
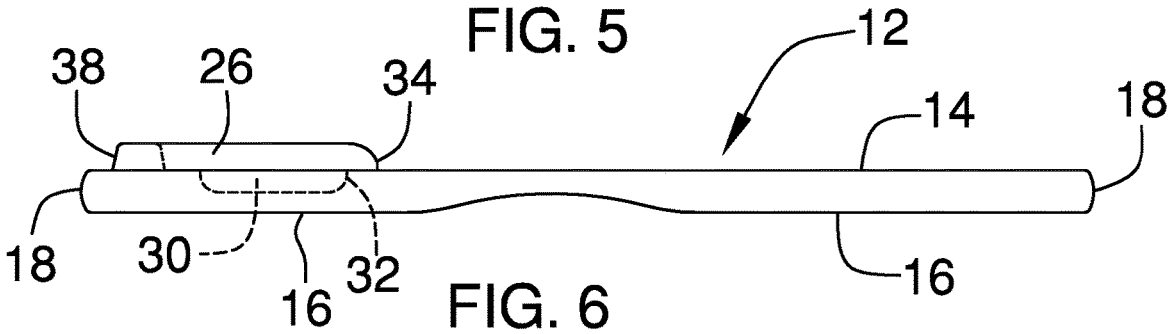
FIG. 6 is a side view of an embodiment of the disclosure and in FIG. 4.

Alternatively, as shown in FIGS. 1 through 3, the rear section 36 of the peripheral edge 38 of the heel alignment pad 26 is flush with the perimeter edge 18 of the panel 12.

Additional embodiments are contemplated. The following descriptions implement similar reference numbering with an alphabetical reference for elements having structure and/or function consistent with previously described elements of the invention.

Figure 11:
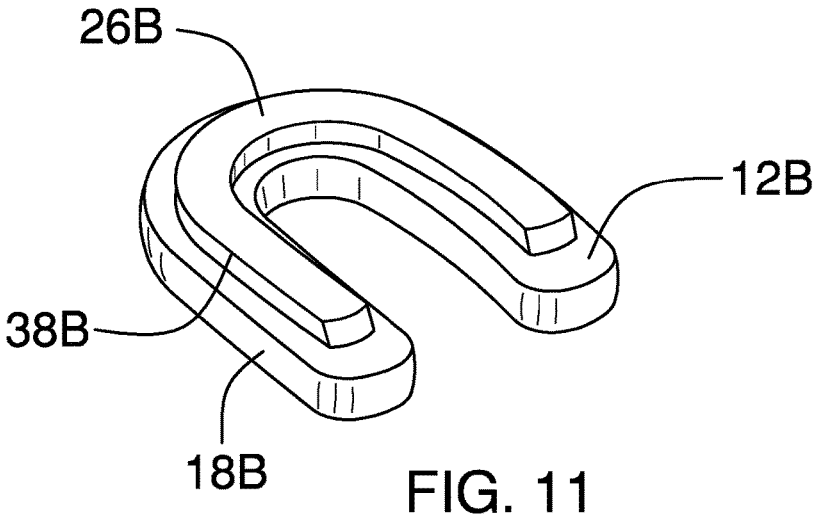
FIG. 11 is a top front side perspective view of an embodiment of the disclosure.
Figure 13:
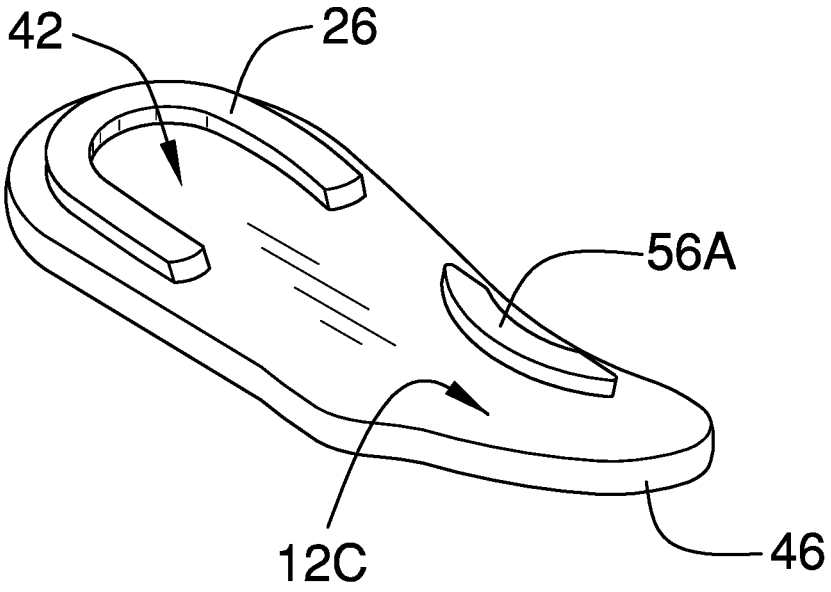
FIG. 13 is a top front side perspective view of an embodiment of the disclosure.

In an embodiment shown particularly in FIG. 13, the panel 12A has a heel portion 42 and a forward portion 44 extending forwardly from the heel portion 42. The forward portion 44 terminates at a curved forward edge 46 such that the panel 12A is configured to extend fully under the heel of the foot and arch of the foot with the curved forward edge 46 extending across under a middle portion of the foot. As shown in FIG. 11, a panel 12B may be provided in which the panel 12B is U-shaped. A heel alignment pad 26B has a perimeter edge 38B extending around the heel alignment pad 26B. A full length of the perimeter edge 38B of the heel alignment pad 26B is inset from the peripheral edge 18B of the panel 12B.

Figure 9:
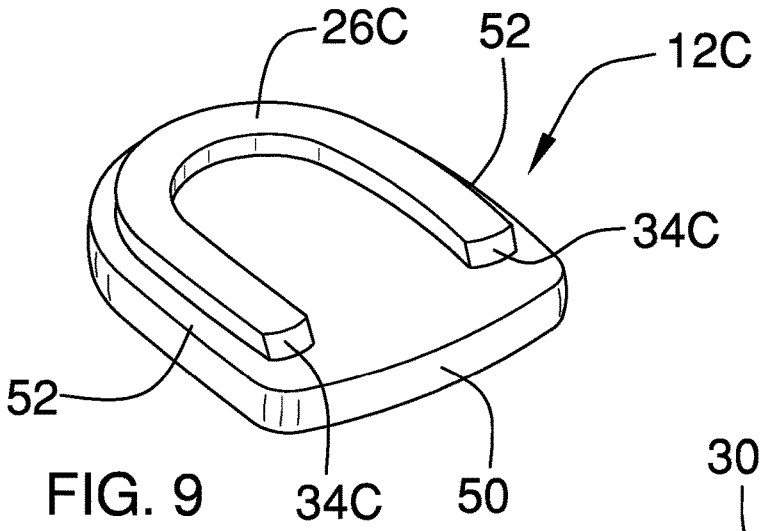
FIG. 9 is a top front side perspective view of an embodiment of the disclosure.
Figure 10:
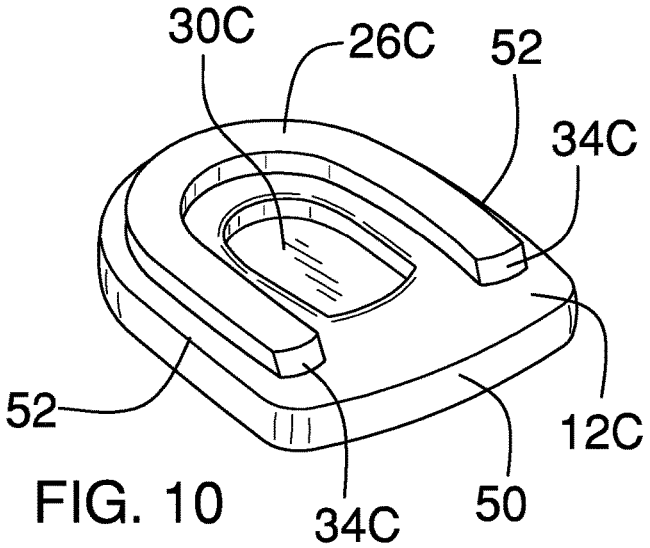
FIG. 10 is a top front side perspective view of an embodiment of the disclosure.

In yet another embodiment, shown particularly in FIGS. 9 and 10, a panel 12C has a forward edge 50 extending between lateral sides 52 of the panel 12C proximate to opposing ends 34C of the heel alignment pad 26C. As shown in FIG. 10, this embodiment may include a heel well 30C.

Figure 12:
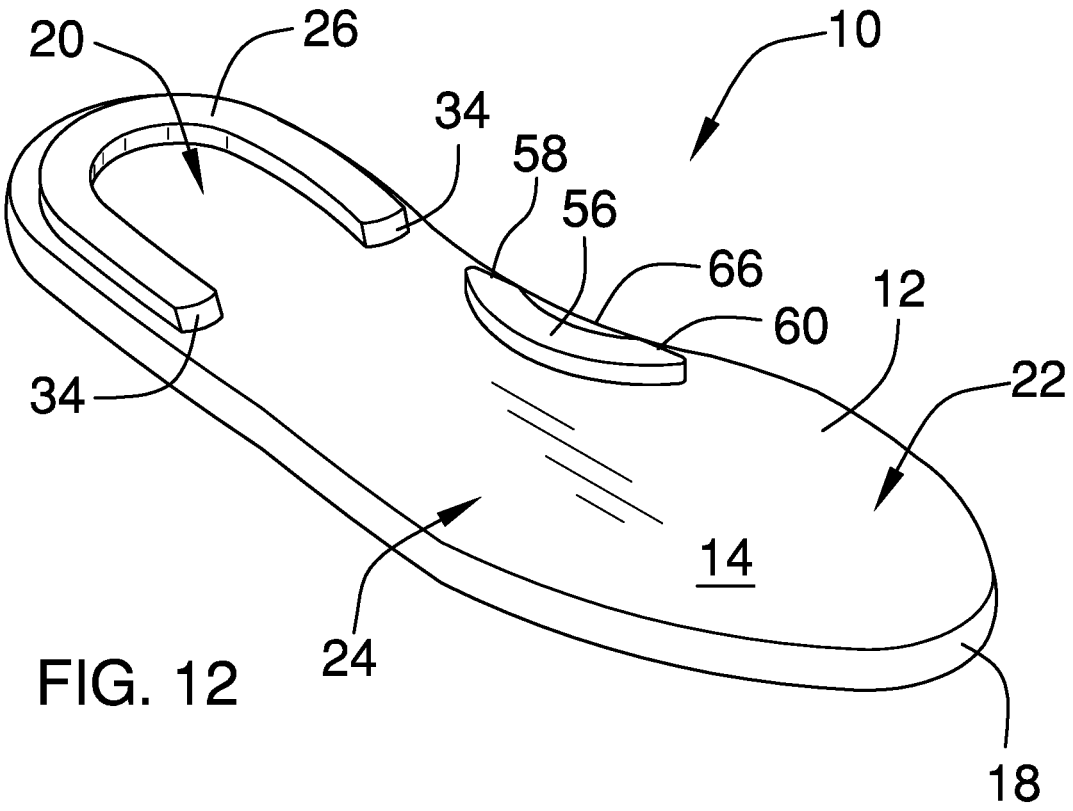
FIG. 12 is a top front side perspective view of an embodiment of the disclosure.

In any of the embodiments, and particularly represented in FIGS. 12 and 13, an arch pad 56 has a first end 58 and a second end 60. The arch pad 56 is elongated between the first end 58 and the second end 60. The arch pad 56 is arcuate extending between the first end 58 and the second end 60. The arch pad 56 is positioned on and extends upwardly from the upper surface 14 of the panel 12 wherein the arch pad 56 is configured to extend along and support an arch of the foot positioned in the shoe. The first end 58 and second end 60 of the arch pad 56 is offset from and facing the perimeter edge 18 of the panel 12 along a lateral interior side 66 of the panel 12 wherein the arch pad 56 extends inwardly from the perimeter edge 14 of the panel 12 between the first end 58 and the second end 60. A similarly structured arch pad 56A is shown with the heel alignment pad 26 and panel 12A in FIG. 13.

It is contemplated, and in view of the above descriptions, believed elements described herein may be incorporated or combined to produce further variations consistent with the disclosure of the invention but not specifically shown in the drawing figures. For example, the heel well 30 consistent with the showing of FIG. 1 or 4 may be provided with the features of the embodiment specifically shown in FIG. 12.

Figure 7:
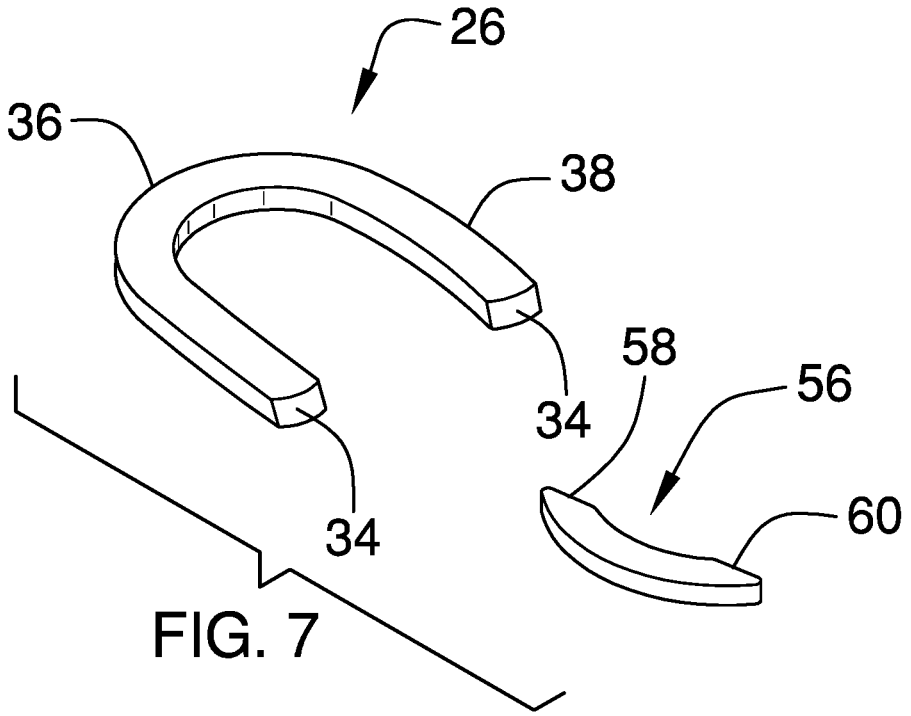
FIG. 7 is a top front side perspective view of cushions of an embodiment of the disclosure.
Figure 8:
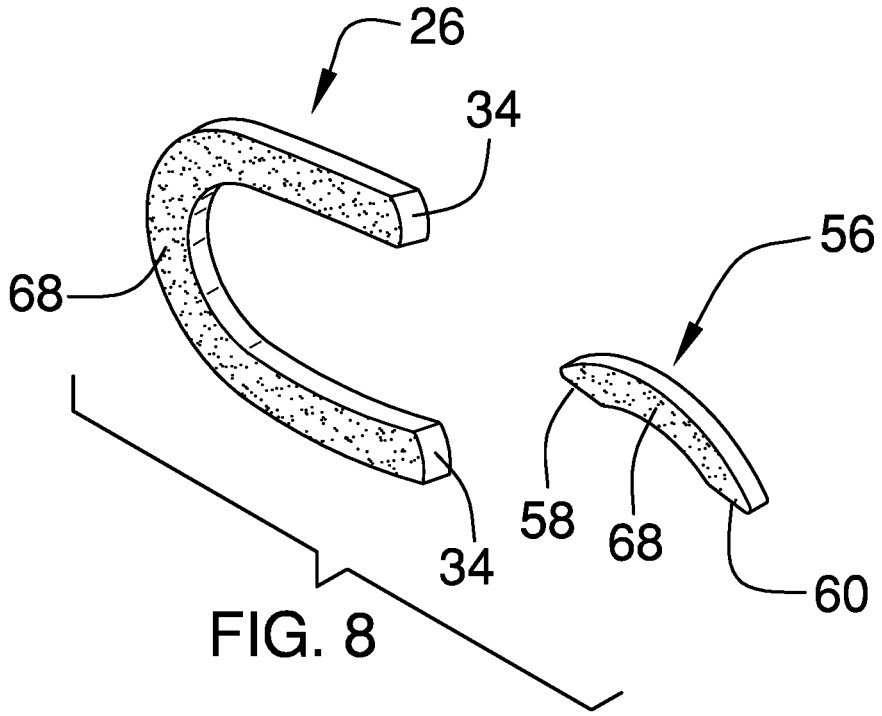
FIG. 8 is a bottom front side perspective view of the cushions of an embodiment of the disclosure.

As shown particularly in FIGS. 7 and 8, each of the heel alignment pad 26 and the arch pad 56 may be provided as separate pieces incorporating an adhesive 68 to allow for some customization of positioning on the upper surface 14 of the panel 12. The arch pad 56 is similarly constructed of a resiliently compressible material which may or may not be the same as the material used to construct the panel 12 and heel alignment pad 26.

In use, the shoe insert device 10 is placed within the shoe in the manner of a conventional insole. Insertion of the foot into the shoe provides for the heel alignment pad 30 to support a peripheral area of the heel of the foot removing some pressure from directly between the upper surface 14 of the panel 12 and a center of the heel of the foot. Further pressure alleviation is achieved through the presence of the heel well 30 which is aligned with the center of the heel of the foot. The varied shape of the panel 12 as shown in the drawing figures and described above provides for customization of support, or lack of additional support, for the middle and front portions of the foot as may be desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shoe insert device configured to support a foot positioned in a shoe, said device comprising:

a panel configured to be positioned in the shoe, said panel having an upper surface, a lower surface, and a perimeter edge extending around said panel, said upper surface of said panel being planar;

a heel alignment pad, said heel alignment pad being U-shaped, said heel alignment pad being positioned on and extending upwardly from said upper surface of said panel wherein said heel alignment pad is configured to extend around and support a heel of the foot positioned in the shoe, a top surface of said heel alignment pad being planar and parallel to said upper surface of said panel; and a heel well extending into said upper surface of said panel, said heel alignment pad extending around said heel well, said heel alignment pad extending fully around said heel well such that a front edge of said heel well is inset from a straight line extending perpendicular to a longitudinal axis of said panel and between opposite ends of said heel alignment pad.

2. The shoe insert device of claim 1, further comprising a rear section of a peripheral edge of said heel alignment pad being flush with said perimeter edge of said panel.

3. The shoe insert device of claim 1, further comprising a rear section of a peripheral edge of said heel alignment pad being inset from said perimeter edge of said panel.

4. The shoe insert device of claim 1, further comprising said panel having a heel portion, a front portion, and a medial portion positioned and extending between said heel portion and said front portion wherein said panel is configured to extend fully under the foot positioned in the shoe.

5. The shoe insert device of claim 1, further comprising said panel having a heel portion and a forward portion extending forwardly from said heel portion, said forward portion terminating at a curved forward edge such that said panel is configured to extend fully under the heel of the foot and arch with said curved forward edge extending across a middle portion of the foot.

6. The shoe insert device of claim 1, further comprising said panel being U-shaped, said heel alignment pad having a perimeter edge extending around said heel alignment pad, a full length of a perimeter edge of said heel alignment pad being inset from said peripheral edge of said panel.

7. The shoe insert device of claim 1, further comprising said panel having a forward edge extending between lateral sides of said panel proximate to opposing ends of said heel alignment pad.

8. The shoe insert device of claim 1, further comprising said panel having a forward edge extending between lateral sides of said panel proximate to opposing ends of said heel alignment pad.

9. The shoe insert device of claim 1, further comprising an arch pad, said arch pad having a first end and a second end, said arch pad being elongated between said first end and said second end, said arch pad being arcuate extending between said first end and said second end, said arch pad being positioned on and extending upwardly from said upper surface of said panel wherein said arch pad is configured to extend along and support an arch of the foot positioned in the shoe.

10. The shoe insert device of claim 9, further comprising said first and second ends of said arch pad being offset from and facing said perimeter edge of said panel along a lateral interior side of said panel wherein said arch pad extends inwardly from said perimeter edge of said panel between said first end and said second end.

11. A shoe insert device configured to support a foot positioned in a shoe, said device comprising:

a panel configured to be positioned in the shoe, said panel having an upper surface, a lower surface, and a perimeter edge extending around said panel, said upper surface of said panel being planar, said panel having a heel portion, a front portion, and a medial portion positioned and extending between said heel portion and said front portion wherein said panel is configured to extend fully under the foot positioned in the shoe;

a heel alignment pad, a top surface of said heel alignment pad being planar and parallel to said upper surface of said panel, said heel alignment pad being U-shaped, said heel alignment pad being positioned on and extending upwardly from said upper surface of said panel wherein said heel alignment pad is configured to extend around and support a heel of the foot positioned in the shoe;

a heel well extending into said upper surface of said panel, said heel alignment pad extending around said heel well, said heel alignment pad extending fully around said heel well such that a front edge of said heel well is inset from a straight line extending perpendicular to a longitudinal axis of said panel and between opposite ends of said heel alignment pad; and a rear section of a peripheral edge of said heel alignment pad being inset from said perimeter edge of said panel.

* * * * *